US005710357A

United States Patent [19]

Grenoble et al.

[11] Patent Number: 5,710,357

[45] Date of Patent: *Jan. 20, 1998

[54] PROCESS FOR RECOVERING OLEFINS FROM CAT-CRACKED GAS WITHOUT ACCUMULATING UNDESIRABLE OXIDES OF NITROGEN

[75] Inventors: Dane Clark Grenoble, Nassau Bay; Roy Thomas Halle, League City, both of Tex.; William Douglas Thomson, Southampton, Great Britain

[73] Assignee: Exxon Chemical Patents Inc., Houston, Tex.

[ * ] Notice: The term of this patent shall not extend beyond the expiration date of Pat. No. 5,444,176.

[21] Appl. No.: 464,492

[22] Filed: Jun. 5, 1995

Related U.S. Application Data

[63] Continuation of Ser. No. 967,835, Oct. 28, 1992, Pat. No. 5,444,176.

[51] Int. Cl.[6] ..... C07C 7/00; F25J 3/00

[52] U.S. Cl. ..... 585/809; 585/853; 585/867; 62/19; 62/23

[58] Field of Search ..... 585/809, 853, 585/867; 62/19, 23

[56] References Cited

U.S. PATENT DOCUMENTS 2,573,341 10/1951 Kniel ..... 585/650

4,743,282 5/1988 Mebra ..... 62/17

5,444,176 8/1995 Grenoble et al. ..... 585/809

*Primary Examiner*—Glenn A. Caldarola

*Assistant Examiner*—In Suk Bullock

*Attorney, Agent, or Firm*—James A. Zboray; Linda K. Russell

[57] ABSTRACT

A safe, effective, and economical method is provided for recovering olefins from cat-cracked gases without accumulating dangerous amounts of nitrogen oxides. A stream of cat-cracked gas first is scrubbed to remove acid gases, including nitrogen dioxide ($NO_2$), and then is passed through a depropanizer fractionation tower. Hydrocarbons having four or more carbon atoms are recovered in the bottoms of the depropanizer, and the overhead from the depropanizer—which is composed of hydrocarbons having three or fewer carbon atoms—is sent to an absorber demethanizer tower. Hydrocarbons having two or more carbon atoms are recovered in the bottoms from the absorber demethanizer tower, where temperatures are no lower than about −45.56° C. (−50° F.) The overhead from the absorber demethanizer tower—which is composed of methane, hydrogen, and trace amounts of nitrogen oxide, $C_2$, and absorbent ($C_3$)—then is chilled to condense and recover trace amounts of $C_2$ and heavier gases, including trace amounts of the $C_3$ absorbent, at temperatures of about −101.11° C. (−150° F.) or higher. Thus, recovery of desired hydrocarbons from the cat-cracked gas is conducted at temperatures that are high enough to prevent the oxidation of nitric oxide (NO) to form nitrogen dioxide ($NO_2$) and high enough to prevent the accumulation of unwanted nitrogen oxides.

26 Claims, 1 Drawing Sheet

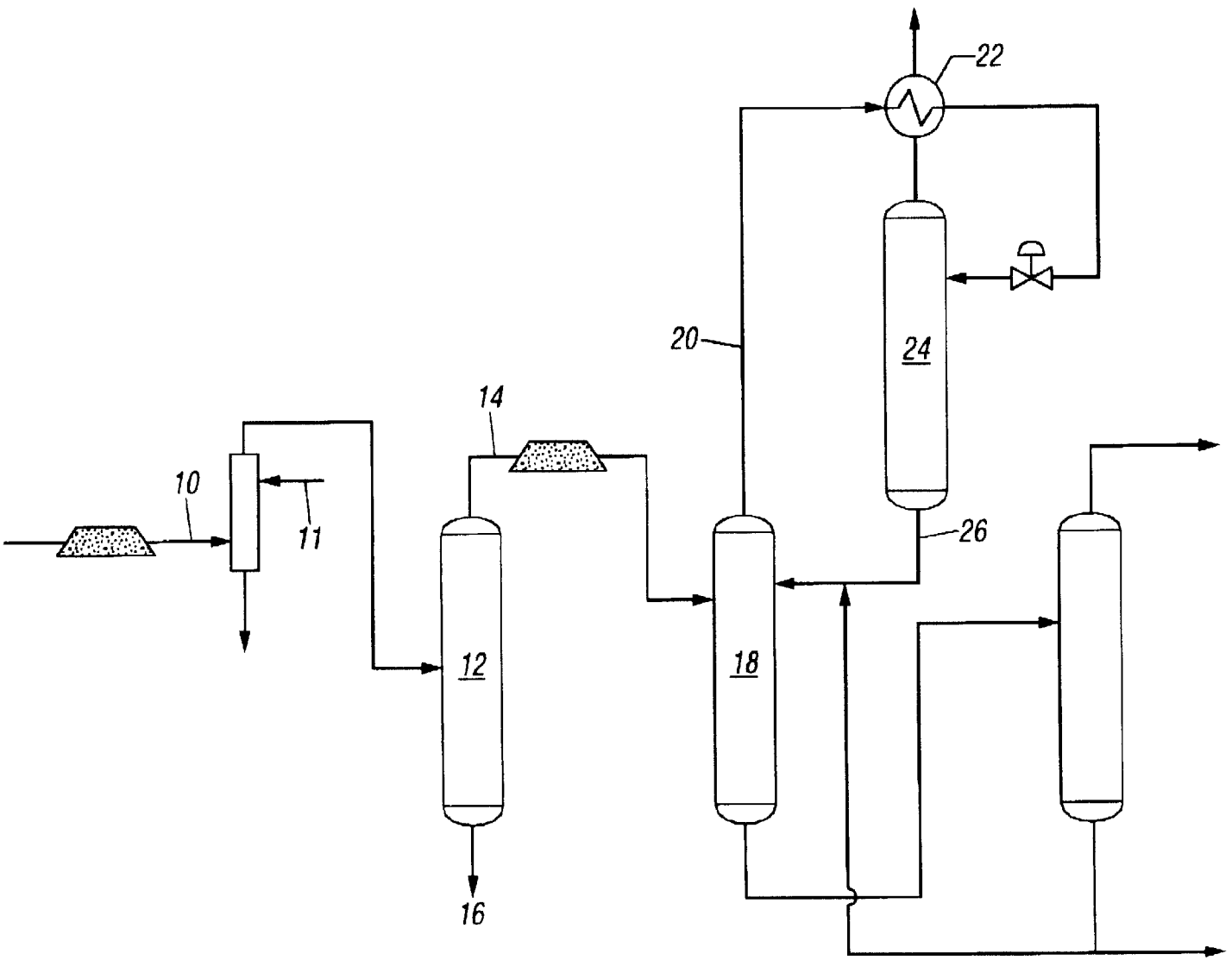
22
24
26
18
20
14
12
16
11
10

PROCESS FOR RECOVERING OLEFINS FROM CAT-CRACKED GAS WITHOUT ACCUMULATING UNDESIRABLE OXIDES OF NITROGEN

This is a continuation of application Ser. No. 07/967,835, filed Oct. 28, 1992, now U.S. Pat. No. 5,444,176.

BACKGROUND OF THE INVENTION

The present invention relates to the recovery of desired hydrocarbons, preferably olefins, from cat-cracked hydrocarbon gas streams. More particularly, the invention relates to the recovery of olefins from cat-cracked gas streams while avoiding the accumulation of unwanted oxides of nitrogen and their reaction products, such as nitric oxide, nitrogen dioxide, dinitrogen trioxide, nitro gums, ammonium nitrite and ammonium nitrate. Accumulations of these compounds have been observed in ethylene recovery facilities. Such accumulations can cause various operating problems, such as equipment plugging and explosion hazards.

Typically, olefins are recovered from cat-cracked gases using cryogenic fractionation in which the coldest temperatures normally fall well below −106.67° C. (−160° F.), and may dip as low as −167.78° C. (−270° F.). Unfortunately, cat-cracked gases tend to be contaminated with nitrogen oxides. Nitric oxide (NO) is of concern in cryogenic separation facilities because nitric oxide boils at a temperature close to the boiling point of methane. Thus, nitric oxide tends to follow the lighter compounds contained in the refinery gas stream. At the very low temperatures used during cryogenic fractionation, nitric oxide may be oxidized by oxygen, which typically is present in cat-cracked gases, to form unwanted nitrogen dioxide ($NO_2$) and dinitrogen trioxide ($N_2O_3$). If ammonia is present during the cryogenic fractionation process, ammonium nitrite ($NH_4NO_2$) and ammonium nitrate ($NH_4NO_3$) may be formed. In the presence of unsaturated hydrocarbons, nitrogen oxides also can react to form $NO_x$gums.

Nitric oxide and nitrogen dioxide are poisonous gases which are undesirable for obvious reasons. Ammonium nitrite, ammonium nitrate, dinitrogen trioxide, nitrogen dioxide and $NO_x$ gums solidify at the extremely low temperatures used during cryogenic fractionation, and, as a result, may plug the equipment and/or may cause a pressure drop in the system. Ammonium nitrite also has been known to decompose spontaneously at temperatures of around 60° C. (140° F.), while ammonium nitrate is reported to decompose spontaneously at 210° C. (410° F.). $NO_x$ gums, particularly those $NO_x$ compounds formed with diolefins, such as butadiene, are reported to be unstable and to explode spontaneously at various temperatures. For all of these reasons, researchers have tried to develop methods to refine cat-cracked gases without accumulating these unwanted nitrogen-based byproducts.

A number of processes have been developed for removing nitrogen based substances from equipment used to refine gases containing oxides of nitrogen. These processes typically are costly and burdensome because they require that the process be shut down so that the equipment involved can be washed or otherwise treated to remove accumulations of the undesirable compounds. Few, if any, preventative processes have been developed by which cat-cracked gas may be refined without accumulating the undesired compounds in the first place. A preventative process which would avoid the accumulation of these compounds would be highly desirable.

SUMMARY OF THE INVENTION

The present invention provides a safe, effective, and economical method for recovering olefins from cat-cracked gases without accumulating dangerous amounts of nitrogen oxides.

According to the present invention, a stream of cat-cracked gas first is scrubbed with an alkaline solution (such as a caustic solution) to remove acid gases from the stream. The stream then is passed through a depropanizer fractionation tower. $NO_2$ and hydrocarbons having four or more carbon atoms are recovered from the depropanizer bottoms stream, and the depropanizer overhead—which is composed of hydrocarbons having three or fewer carbon atoms—is sent to an absorber demethanizer tower. The overhead typically contains nitric oxide (NO). Hydrocarbons having two or more carbon atoms are recovered in the bottoms stream from the absorber demethanizer tower. Temperatures above −45.56° C. (−50° F.) are satisfactory for this step. The overhead from the absorber demethanizer tower—which is composed of methane, hydrogen, trace amounts of nitrogen oxides, trace amounts of $C_2$'s, and absorbent ($C_3$)—then is cooled.

The cooled overhead separates into a vapor stream of hydrogen/methane and a condensate containing most of the $C_2$'s and $C_3$'s remaining in the demethanizer overhead, which may be recirculated back to the absorber demethanizer tower for recovery. Cooling of the absorber demethanizer overhead preferably is accomplished by a Joule Thomson expansion. The stream first is cooled against the expanded hydrogen and methane tall gas stream, then depressurized and fed to a separator drum. The liquid from the drum is recovered and the hydrogen and methane vapor from the drum is used to cool the demethanizer overhead. Temperatures above about −101.11° C. (−150° F.) are satisfactory for these separations. Thus, the process is conducted at temperatures that are high enough to prevent the oxidation of nitric oxide and avoid the accumulation of unwanted $NO_x$ compounds.

BRIEF DESCRIPTION OF THE DRAWINGS

FIG. 1 is a simplified flow diagram of a facility in which cat-cracked gases are refined according to the process of the present invention.

DETAILED DESCRIPTION OF THE INVENTION

With reference to FIG. 1, it should be understood that, when a stream is identified, the stream actually represents a pipeline. Also, it should be understood that the usual flow-control valves, temperature regulatory devices, pumps, heat exchangers, accumulators, condensers, and the like ("auxiliary equipment"), are operating in a conventional manner.

Referring to FIG. 1, after compression and cooling, the cat-cracked gas stream flows through a line 10 to feed a caustic scrubbing tower 11. The stream then is fed to a standard depropanizer tower 12. The gas stream is separated by the depropanizer tower 12 into (1) an overhead containing hydrocarbons having three or fewer carbon atoms (with normal contaminants, such as trace $C_4$'s), which exits the depropanizer tower 12 via line 14, and (2) a bottoms 16, containing hydrocarbons having four or more carbon atoms, which exits the depropanizer tower 12 via line 16. The processing of the bottoms from the depropanizer tower 12 does not form a part of the present invention, and will not be discussed further. The overhead from the depropanizer tower 12 flows through the line 14 and through various auxiliary equipment and feeds into an absorber demethanizer tower 18.

In a preferred embodiment, the absorbent used in the absorber demethanizer tower 18 is "the $C_3$ cut." The $C_3$ cut is a preferred absorbent because the $C_3$ cut has a high capacity (per pound of absorber oil) to absorb $C_2$'s at relatively warm temperatures of about −28.89° C. (−20° F.) to −40° C. (−40°F.). Also, small quantities of the $C_3$'s, which are lost in the absorber demethanizer overhead stream, can be recovered by moderate chilling to temperatures of −78.89° C. (−110°F.) to −90°C. (−130° F.), or alternately by a second absorption step using an absorbent with a higher boiling point. The temperatures used in the process do not approach −106.67° C. (−160° F.), which is the temperature at which unwanted compounds of nitric oxide reportedly begin to accumulate.

The overhead from the absorber demethanizer tower 18 passes from the demethanizer tower 18 through a line 20, preferably at a pressure of about 2,757,904 −3,447,380 Newtons/$m^2$(400–500 psi). In order to recover most of the remaining $C_2$ and $C_3$ hydrocarbons from the overhead of the absorber demethanizer tower 18, the overhead preferably is cooled using Joule Thomson expansion of the hydrogen/methane gas stream. To accomplish this, the overhead is fed through at least one heat exchanger 22. Then the overhead is depressured to a drum 24 where condensed liquid is separated from the hydrogen/methane gas stream at a temperature of about −78.89° C. (−110° F.) to 90° (−130° F.) and the liquid containing recovered $C_2$'s and $C_3$'s is returned to the demethanizer absorber tower 18 as stream 26 for recovery. The hydrogen/methane overhead from drum 24 is used as the chilling medium in exchanger 22. Because the overhead from the absorber demethanizer tower 18 contains more $C_3$ hydrocarbons than $C_2$ hydrocarbons, the condensing temperature of the $C_3$ and heavier portion is not low enough to facilitate the accumulation of undesirable oxides of nitrogen.

One of skill in the art will recognize that a similar result could be achieved by other means. For example, instead of using Joule Thomson expansion to cool the absorber demethanizer overhead, a second step could be added in which heavier oil was used as an absorbent to recover the $C_2$ and $C_3$ hydrocarbons from the overhead. The use of a heavier oil as an absorbent also would permit processing at relatively high temperatures and thus would further reduce the risk of unwanted accumulation of nitrogen oxide compounds.

One of skill in the art will appreciate that many modifications may be made to the embodiments described herein and explained in the accompanying figure without departing from the spirit of the present invention. Accordingly, the embodiments described herein are illustrative only and are not intended to limit the scope of the present invention.

We claim:

1. A process for preventing the accumulation of undesirable oxides of nitrogen during the recovery of one or more desired hydrocarbons from cat-cracked gas comprising:

passing said gas through an alkaline solution to remove acid gases;

passing said gas through a depropanizer at a temperature between about −28.89° C. (−20° F.) to −40° C. (−40° F.) to form a first portion and a second portion;

passing said first portion through an absorber demethanizer at a temperature above about −45.56° (−50° F.) to form a third portion and a fourth portion;

recovering at least one desired hydrocarbon from said third portion at temperatures above about −106.67° C. (−160° F.).

2. The process of claim 1 wherein said recovering step comprises chilling said third portion to a temperature between about −78.89° C. (−110° F.) and −101.11° C. (−150° F.) whereby said third portion is separated into a fifth and a sixth portion.

3. The process of claim 2 wherein said chilling step comprises heat exchanging said sixth portion with said third portion after expansion of said third portion.

4. The process of claim 3 wherein said expansion is a Joule Thomson expansion.

5. The process of claim 1 wherein said first portion primarily comprises hydrocarbons having no more than three carbon atoms and said second portion primarily comprises hydrocarbons having at least four carbon atoms.

6. The process of claim 4 wherein said first portion primarily comprises hydrocarbons having no more than three carbon atoms and said second portion primarily comprises hydrocarbons having at least four carbon atoms.

7. The process of claim 1 wherein said third portion primarily comprises compounds selected from the group consisting of methane, hydrogen, nitrogen-containing compounds, and a small proportion of hydrocarbons having two and three carbon atoms, and said fourth portion primarily comprises hydrocarbons having at least two carbon atoms.

8. The process of claim 6 wherein said third portion primarily comprises compounds selected from the group consisting of methane, hydrogen, nitrogen-containing compounds, and a small proportion of hydrocarbons having two and three carbon atoms, and said fourth portion primarily comprises hydrocarbons having at least two carbon atoms.

9. The process of claim 2 wherein said fifth portion comprises a fraction enriched in hydrocarbons having two and three carbon atoms and said sixth portion primarily comprises compounds selected from the group consisting of hydrogen, methane, and nitric oxide.

10. The process of claim 8 wherein said fifth portion primarily comprises hydrocarbons having two and three carbon atoms and said sixth portion primarily comprises compounds selected from the group consisting of hydrogen, methane, and nitric oxide.

11. The process of claim 1 wherein said recovering step comprises absorbing said at least one desired hydrocarbon from said third portion using a hydrocarbon absorbent having more than three carbon atoms.

12. The process of claim 1 wherein said first portion is passed through said absorber demethanizer at temperatures between about −28.89° C. (−20° F.) and −40° C. (−40° F.).

13. The process of claim 12 wherein said recovering step comprises chilling said third portion to a temperature between about −78.89° C. (−110° F.) and −101.11° C. (−150° F.) whereby said third portion is separated into a fifth and a sixth portion.

14. The process of claim 13 wherein said chilling step comprises heat exchanging said sixth portion with said third portion after expansion of said third portion.

15. The process of claim 14 wherein said expansion is Joule Thomson expansion.

16. The process of claim 12 wherein said first portion primarily comprises hydrocarbons having no more than three carbon atoms and said second portion primarily comprises hydrocarbons having at least four carbon atoms.

17. The process of claim 13 wherein said first portion primarily comprises hydrocarbons having no more than three carbon atoms and said second portion primarily comprises hydrocarbons having at least four carbon atoms.

18. The process of claim 16 wherein said third portion primarily comprises compounds selected from the group consisting of methane, hydrogen, nitrogen-containing compounds, and a small proportion of hydrocarbons having two and three carbon atoms, and said fourth portion primarily comprises hydrocarbons having at least two carbon atoms.

19. The process of claim 17 wherein said third portion primarily comprises compounds selected from the group consisting of methane, hydrogen, nitrogen-containing compounds, and a small proportion of hydrocarbons having two and three carbon atoms, and said fourth portion primarily comprises hydrocarbons having at least two carbon atoms.

20. The process of claim 18 wherein said fifth portion primarily comprises a fraction enriched in hydrocarbons having two and three carbon atoms and said sixth portion primarily comprises compounds selected from the group consisting of hydrogen, methane, and nitric oxide.

21. The process of claim 19 wherein said fifth portion primarily comprises hydrocarbons having two and three carbon atoms and said sixth portion primarily comprises compounds selected from the group consisting of hydrogen, methane, and nitric oxide.

22. The process of claim 12 wherein said recovering step comprises absorbing said at least one desired hydrocarbon from said third portion using a hydrocarbon absorbent having more than three carbon atoms.

23. The process of claim 13 wherein said temperature of said third portion is reduced to between about −78.89° C. (−110° F.) and −90° C. (−130−° F.) during said chilling step.

24. The process of claim 19 wherein said temperature of said third portion is reduced to between about −78.89° C. (−110° F.) and −90° C. (−13020 F.) during said chilling step.

25. The process of claim 12 wherein said desired hydrocarbon is an olefin.

26. The process of claim 24 wherein said desired hydrocarbon is an olefin.

* * * * *